United States Patent [19]

Lacour

[11] 4,140,268

[45] Feb. 20, 1979

[54] CENTRIFUGATING DEVICE FOR BIOLOGICAL LIQUIDS, HAVING A ROTATABLE CONTAINER, AND SUPPORTING BRACKET THEREFOR

[75] Inventor: André Lacour, Corsier, Switzerland

[73] Assignee: Haemo-Transfer S.A., Vaduz, Liechtenstein

[21] Appl. No.: 809,015

[22] Filed: Jun. 22, 1977

Related U.S. Application Data

[63] Continuation-in-part of Ser. No. 777,932, Mar. 15, 1977, abandoned.

[51] Int. Cl.[2] ..... B04B 7/00

[52] U.S. Cl. ..... 233/1 A; 233/28

[58] Field of Search ..... 233/1 R, 1 A, 1 C, 21, 233/22, 27, 28, 20 R, 20 A

[56] References Cited

U.S. PATENT DOCUMENTS

| | | | |
|---|---|---|---|
| 2,043,350 | 6/1936 | Forsberg | 233/1 A |
| 2,171,136 | 8/1939 | Bergner | 233/1 A |
| 3,527,402 | 9/1970 | Kobetsky | 233/1 A |
| 3,565,330 | 2/1971 | Latham | 233/1A |
| 3,581,981 | 6/1971 | Latham | 233/21 |
| 4,017,023 | 4/1977 | Hemfort | 233/1 A |

*Primary Examiner*—George H. Krizmanich

*Attorney, Agent, or Firm*—Young & Thompson

[57] ABSTRACT

A centrifugating device for biological liquids, e.g. blood, in which a rotatable container carries a specially shaped seal that surrounds and bears on a fixed assembly with a minimum area of interface between the fixed and rotating parts. This seal is disposed outside the path of the liquid to be treated. The fixed assembly, in turn, is releasably carried by a bracket, the bracket being selectively longitudinally extensible as well as selectively adjustably swingable about a vertical axis of oscillation eccentric to the centrifuge, thereby to permit exact positioning of the fixed assembly coaxially of the rotatable container. The parts are so simple and inexpensive in construction that at least some of them can be used once and thrown away. Moreover, the fixed assembly is easily insertable in sealed relationship in any of a variety of containers, by the simplest of manual assembly and disassembly operations.

15 Claims, 7 Drawing Figures

CENTRIFUGATING DEVICE FOR BIOLOGICAL LIQUIDS, HAVING A ROTATABLE CONTAINER, AND SUPPORTING BRACKET THEREFOR

This application is a continuation-in-part of my copending application Ser. No. 777,932 now abandoned, filed Mar. 15, 1977.

The present invention relates to a centrifuge for biological liquids and a supporting bracket therefor, comprising a fixed assembly for the inflow and outflow of the liquid to be separated, this fixed assembly being supported by the supporting bracket, a container mounted for rotation about this fixed assembly, and means for driving in rotation said containers.

As the driving means are conventional they will not be described or shown and the remaining part of the centrifuge will be called the centrifugating device in the following specification.

In the field of the separation of biological liquids by centrifucation, it is desirable that the centrifugating device not generate a great deal of frictional heat in operation, and that the liquid not be subjected to a too violent mechanical action. It is also necessary that the centrifugating device be completely sealed against the undesired inflow or outflow of gases and liquids, in order to avoid any contamination of the liquid to be treated or any contamination of the environment by the liquid treated, and also that the materials of construction of the centrifugating device cannot contaminate the biological liquid.

Accordingly, it is an object of the present invention to provide a centrifugating device which achieves these desiderata.

Another object of the present invention is the provision of a supporting bracket for the fixed assembly of such a centrifugating device, by which the fixed assembly can be centered relative to the rotatable container of the centrifuge.

Finally, it is an object of the present invention to provide a centrifugating device for biological liquids, and a supporting bracket therefor, which will be relatively simple and inexpensive to manufacture, easy to assemble, adjust and operate, and rugged and durable in use.

According to the present invention, these objects are achieved by providing a centrifugating device for biological liquids, e.g. blood, in which a rotatable container carries a specially shaped seal that surrounds and bears on a fixed assembly with a minimum area of interface between the fixed and rotating parts. This seal is disposed outside the path of the liquid to be treated. The fixed assembly, in turn, is releasably carried by a bracket, the bracket being selectively longitudinally extensible as well as selectively adjustably swingable about a vertical axis of oscillation eccentric to the centrifugating device, thereby to permit exact positioning of the fixed assembly coaxially of the rotatable container. The parts are so simple and inexpensive in construction, that at least some of them can be used once and thrown away. Moreover, the fixed assembly is easily insertable in sealed relationship in any of a variety of containers, by the simplest of manual assembly and disassembly operations.

These and other objects, features and advantages of the present invention will become apparent from a consideration of the following description, taken in connection with the accompanying drawings, in which.

Figure 1:
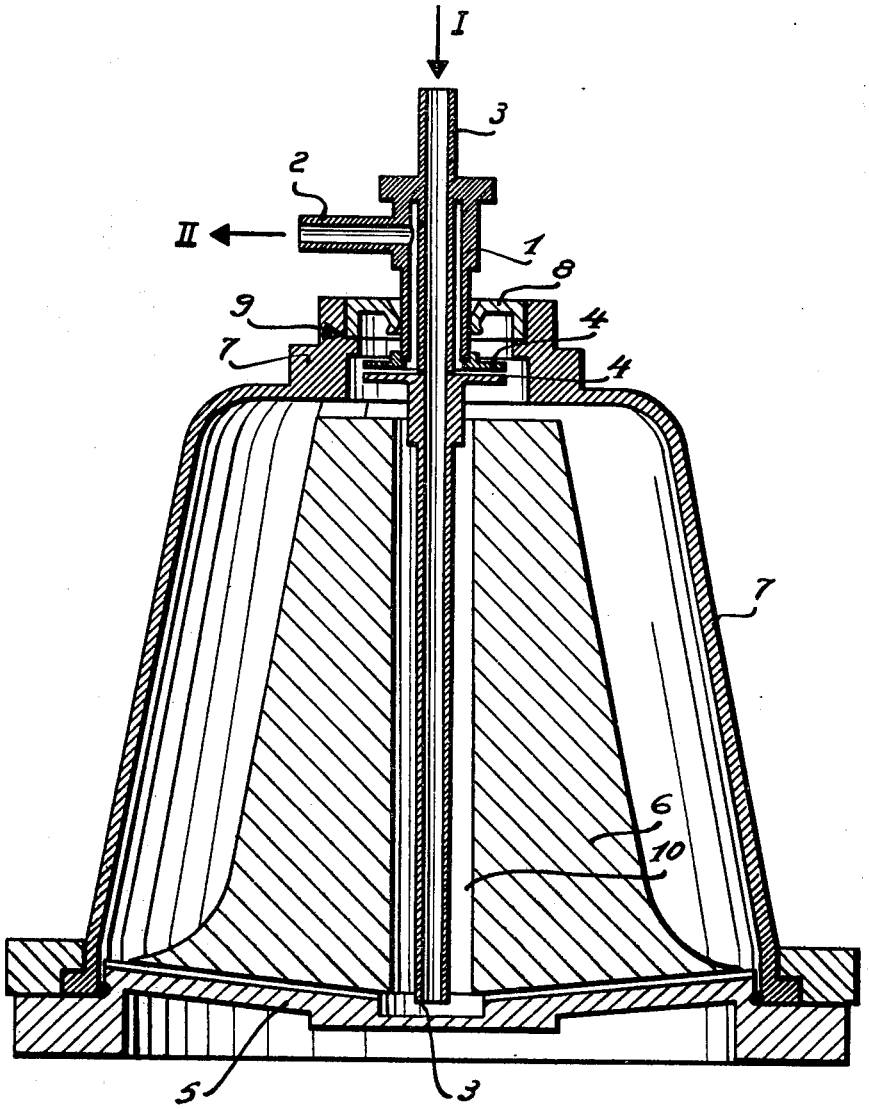
FIG. 1 is a cross-sectional view of a first embodiment of centrifugating device according to the present invention.

Referring now to the drawings in greater detail, and first to the embodiment of FIG. 1, there is shown a centrifugating device according to the present invention, comprising a fixed assembly including a head 1 having a laterally outwardly extending outlet conduit 2 for the centrifuged liquid and a central feeding conduit 3 for the biological liquid to be introduced. The biological liquid is introduced in the direction of the arrow I and the centrifuged liquid is removed in the direction of the arrow II. Two separation discs or diaphragms 4, 4' are fixed and horizontally centered on the lower part of head 1.

The rotating part of the centrifugating device comprises a rotating circular bottom plate 5 which is secured to an internal element 6 with channels provided for the radially outward flow of liquid between members 5 and 6. An external casing 7 is secured at its lower margin to plate 5 and terminates upwardly in an annular upper portion 7' that has a radially inwardly extending shoulder 9 thereon. An annular seal 8 of blood compatible elastic deformable material, e.g. silicone rubber, is seated on flange 9 on the interior of portion 7' and is easily insertable in and removable from portion 7'. However, seal 8 rotates with portion 7', in substantially line contact with the outer cylindrical surface of head 1, which remains stationary. Thus, there is a rotary seal between 1 and 8, whose contact surface is as small as possible, and as indicated above is substantially line contact.

It is to be understood that seal 8 is inserted with and removed with the fixed assembly 1–3, whereby emplacement and removal of this assembly in the rotatable container is rendered quite easy by the mere frictional engagement of seal 8 in portion 7', much in the manner of the insertion and removal of a rubber stopper. However, as indicated above, seal 8 rotates with the container, whereas the rest of the assembly 1–3 remains stationary in use.

It is also to be understood that the materials from which this embodiment of the centrifugating device is constructed, are so inexpensive that many portions thereof, such as the seal 8 and/or the fixed assembly 1–3, can be discarded after one use and so need not be cleaned and sterilized. Apart from seal 8, which, as indicated above, can be silicone rubber, the rest of the centrifuge shown in FIG. 1 can be of clear plastic, preferably acrylic resin, e.g. polymethyl-methacrylate or polycarbonate.

In use, the biological liquid, e.g. blood, is introduced in the direction of the arrow I into conduit 3, and flows downward onto rotating plate 5, by which the liquid is directed radially outwardly to casing 7, whence it flows up to the discs 4, 4' and passes beneath these discs to flow down again through annular passageway 10 between 3 and 6, so as to create a closed circulation inside the centrifugating device. When the quantity of the liquid exceeds a predetermined amount, a centrifugally separated portion of the liquid passes between the separation discs 4 and 4' and is discharged radially outwardly through the outlet conduit 2 in the direction of the arrow II.

It will of course be understood that the rotatable container of the centrifugating device is rotated by any conventional mechanism (not shown); while the fixed assembly 1–3 is supported in a manner described in greater detail hereinafter in connection with FIGS. 3–5. It is also to be noted that the seal 8 is not directly in the path of the liquid treated, and that there accordingly need be no flow of any material past seal 8 in either direction.

Figure 2:
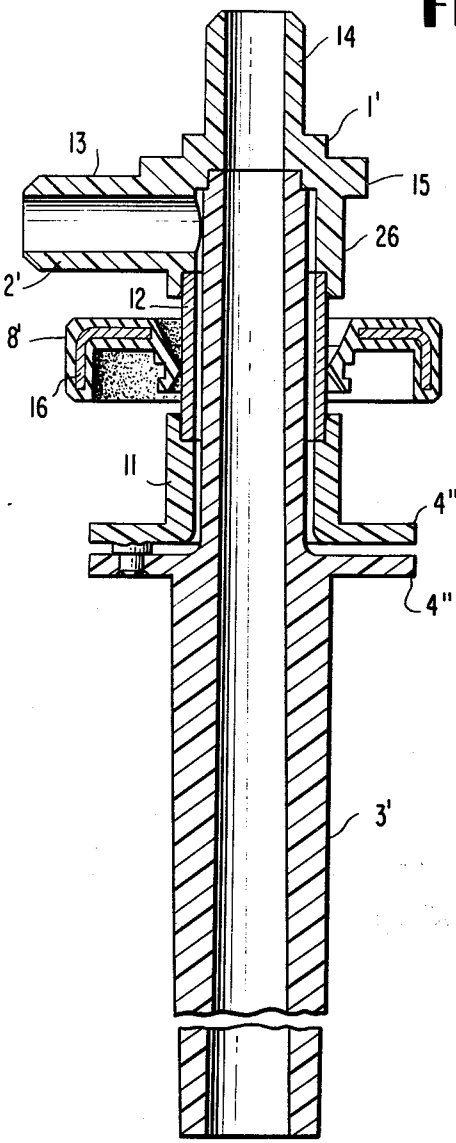
FIG. 2 is a cross-sectional view of a modified and preferred form of fixed assembly of the centrifugating device.

Turning now to FIG. 2, there is shown a modified and preferred form of the fixed central assembly of the centrifugating device of the present invention, the parts of FIG. 2 that correspond to FIG. 1 being indicated by the same reference numerals appropriately primed. Thus, in FIG. 2, the fixed head 1' has a discharged conduit 2' and an inlet conduit 3' with spaced discs 4'' and 4'''. However, the latter of these discs terminates radially inwardly in an upstanding sleeve 11 which receives a stainless steel cylindrical sleeve 12, and the head 1' being comprised by a short section 13 that terminates upwardly in an inlet portion 14. As best seen in FIG. 3, section 13 also carries a rectangular flange 15, for a purpose to be described.

In the embodiment of FIG. 2, the seal 8' can be similar to that of FIG. 1, but is preferably provided with a steel core 16 molded into the silicone rubber thereof, core 16 duplicating the general contour of seal 8' and thus comprising a cylindrical outer flange portion and a uniplanar radially inwardly extending flange portion, so as to impart to seal 8' greater overall stiffness without correspondingly stiffening the region of sealing contact of seal 8' with sleeve 12, this rotary interface comprising, as also in FIG. 1, substantially line contact.

It will of course be appreciated that the embodiment of FIG. 2 is even simpler to construct and assemble and provides improved operation as compared to that of FIG. 1. Moreover, the assembly can be easily effected, the members 11, 12 and 13 being interconnected by cementing, the seal 8' being of course first slipped over the sleeve 12. Members 11, 3' and 13 can also be interconnected by cementing or ultrasonic bonding. The line contact between the silicone rubber of seal 8' and the stainless steel of sleeve 12, provides minimum friction and minimum contamination; and the assembly of the device of FIG. 2 ensures minimum cost of parts and greatest ease of assembly.

Figure 3:
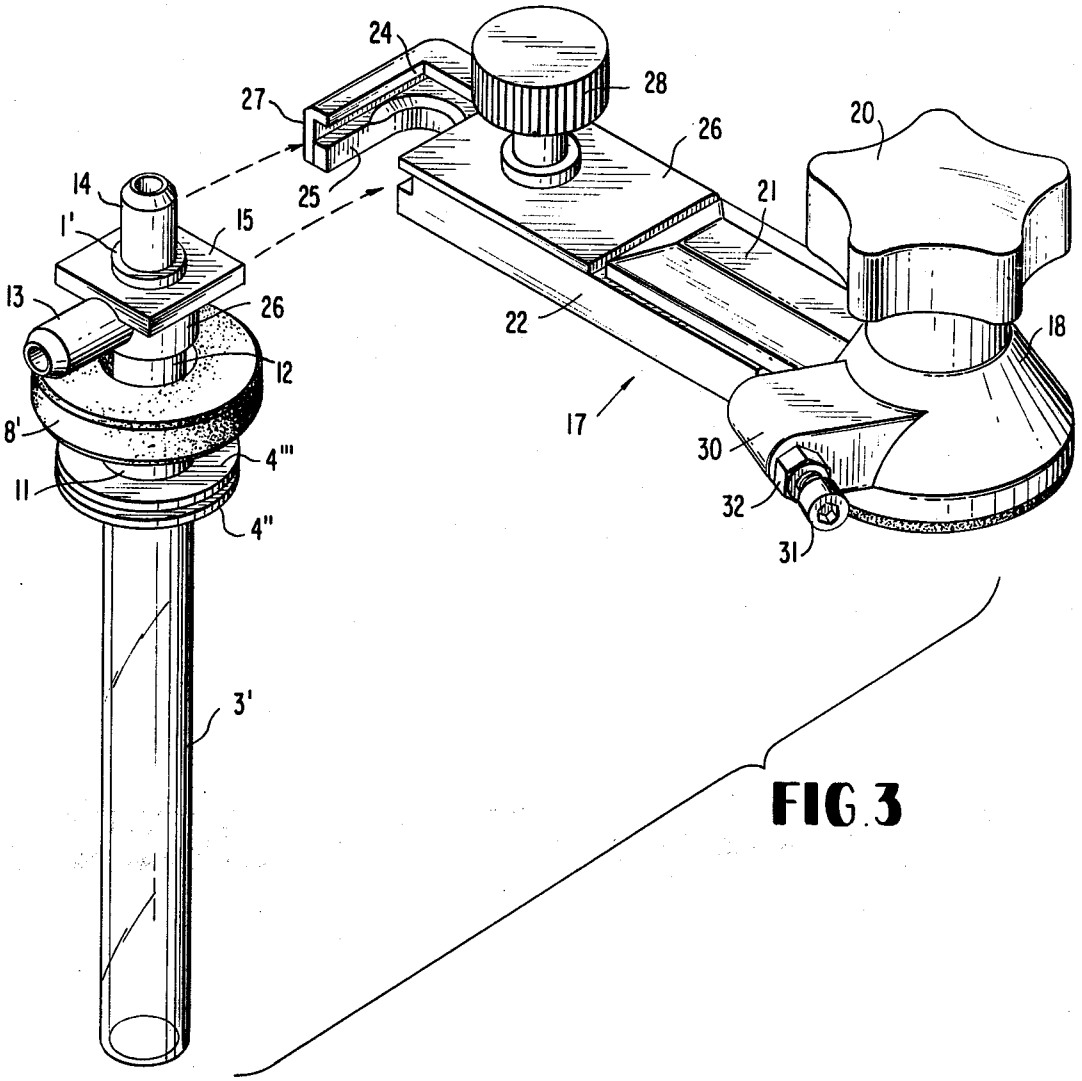
FIG. 3 is an exploded perspective view of the fixed assembly of FIG. 2 and the supporting bracket therefor.

Turning now to FIG. 3, it will be seen that the fixed assembly of the centrifugating device of the present invention is adapted to be releasably secured by means of its rectangular flange 15, in a support by which the position of the axis of the fixed assembly can be precisely regulated in any horizontal direction relative to the rotatable part or container of the centrifuge. The support comprises a bracket generally indicated at 17, whose structure is shown in greater detail in FIGS. 4 and 5.

As is there shown, bracket 17 comprises a hub 18 by which the bracket is releasably secured to a fixed support 19 by manipulation of a screw-threaded knob 20. An arm 21 extends radially outwardly from hub 18 and carries on its underside a bracket 22 that has slots 23 therethrough that are elongated in a radial direction relative to hub 18, so that setscrews 23' may be loosened or tightened selectively to permit or prevent lengthwise adjustment of the position of bracket 22 relative to hub 18.

The outer end of bracket 22 is provided with a rectangular recess 24 for the reception of flange 15, the bottom of recess 24 being relieved to provide a recess 25 that opens to one side of bracket 22 and its inner end has a semicircular curvature that mates with a cylindrical surface 26 on fixed head 1'. The top of recess 24, the outer side of recess 24, and one lateral side of recess 24, are closed by a clamping plate 26 whose downwardly depending flange 27 extends over the outer end of bracket 22 and over and along one lateral side of bracket 22, as best seen by comparison of FIGS. 4 and 5. Clamping plate 26 is releasably secured to bracket 22 by means of a knurled screw-threaded knob 28; and the disengagement of clamping plate 26 from bracket 22 upon unscrewing knob 28, thereby to release flange 15 for the removal thereof from the bracket or for the insertion thereof into the bracket, is initiated by a plurality of small rubber bumpers 29, of which only one is shown in FIG. 4, that are recessed into bracket 22 and project above the upper surface of bracket 22 in their undeformed, that is, their uncompressed condition.

Extending laterally outwardly from hub 18 is an integral arm 30 in which is screw-threadedly received a set-screw 31 with a locking nut 32 thereon. The head of screw 31 is adapted to contact a fixed abutment (not shown); and rotation of screw 31 to move its head closer to or farther from bracket 30 will thus fix the horizontally swung position of bracket 17 about the axis of support 19.

It will therefore be understood that, by manipulation of screws 23' and 31, with adjustment of the horizontal position of bracket 22 relative to hub 18 and the corresponding adjustment of the rotated position of hub 18 about support 19, the exact positioning of the axis of the fixed assembly 1–3 or 1'–3' can be insured so that the fixed and rotatable parts of the centrifugation device are precisely coaxial. In this way, rapid deformation of the seal 8 or 8' during rotation is avoided.

Figure 4:
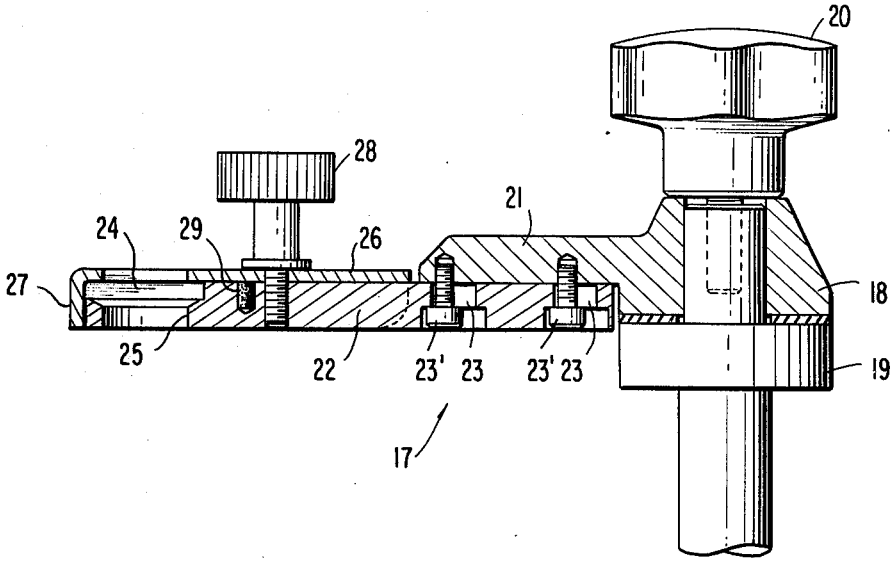
FIG. 4 is a cross-sectional view of the supporting bracket.
Figure 5:
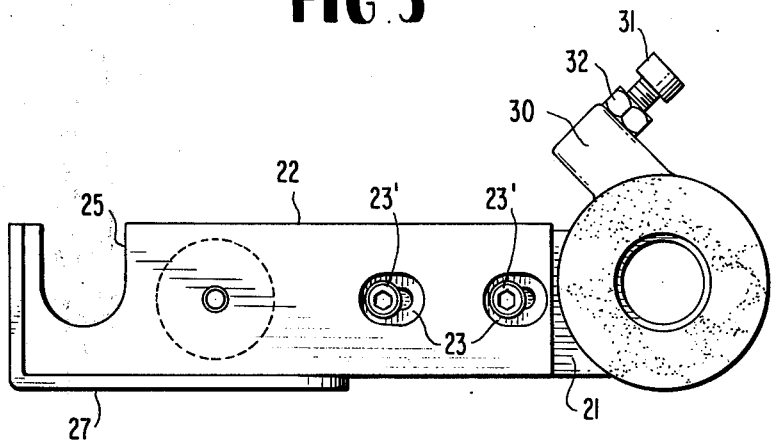
FIG. 5 is a bottom plan view of the supporting bracket.

It will of course be understood that the embodiment of FIG. 1 is equally well adapted for use with the bracket of FIGS. 3–5, as is the embodiment of FIG. 2.

It will also be understood that, except as hereinafter claimed, the rotatable container of the centrifugation device can have a variety of forms other than that shown in FIG. 1. For example, the rotatable portion can be a conventional glass container, or can be cylindrical, or can have any of a variety of other configurations.

Figure 6:
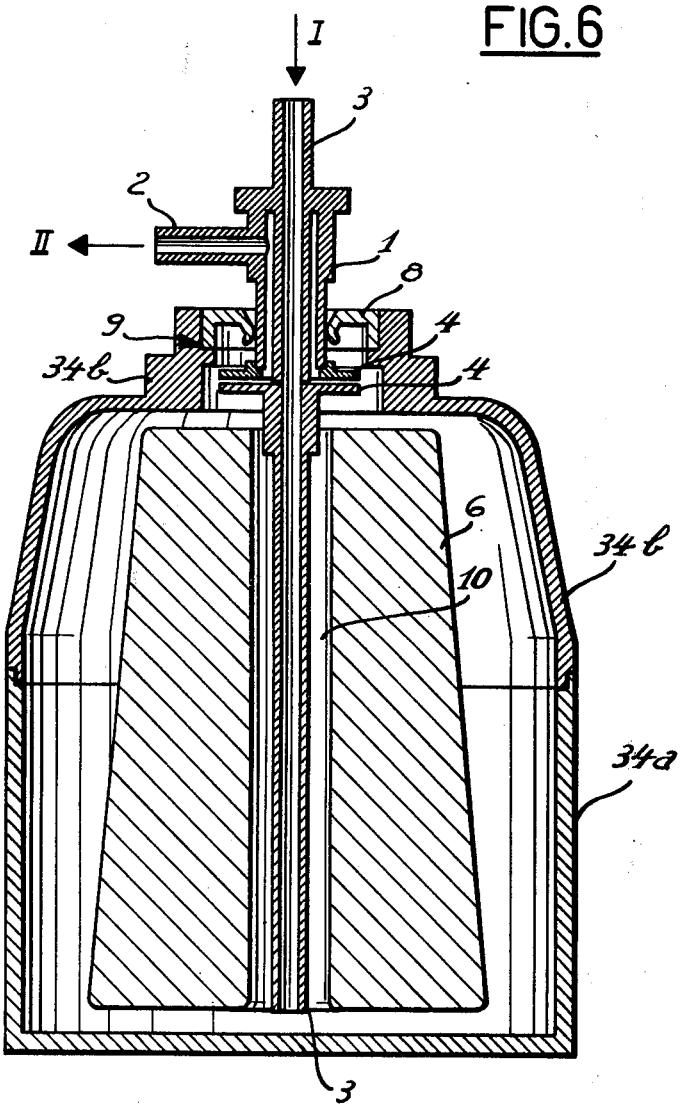
FIGS. 6 and 7 show two variants of possible shapes for the rotatable container of the centrifugating device.

FIG. 6 shows a variant of this centrifugating device in which the fixed assembly is similar to the one previously described used in relation with a rotatable container 34*a*, 34*b*. This container is very easy to manufacture and comprises a bottom part 34*a* of general cylindrical shape and an upper portion 34*b*, adapted to receive the fixed assembly of the centrifugating device. The bottom and upper portions of the containers are fitted together and sealed.

Figure 7:
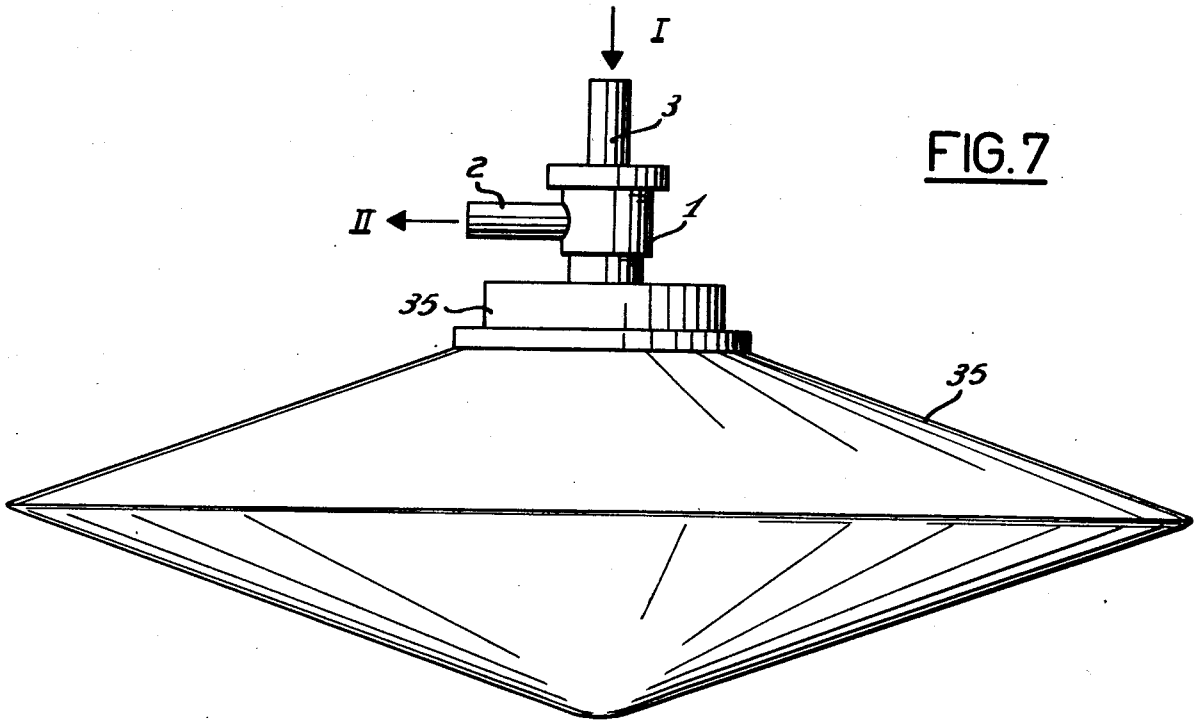

The variant shown in FIG. 7 uses again the same fixed assembly of the centrifugating device in combination with a biconical type rotatable container 35. This container 35 can be made of supple plastic material in order to store it flat, reducing thus the storing space of the whole centrifugating device.

From a consideration of the foregoing disclosure, therefore, it will be evident that all the initially recited objects of the present invention have been achieved.

Although the present invention has been described and illustrated in connection with certain embodiments, it is to be understood that modifications and variations may be resorted to without departing from the spirit of the invention, as those skilled in this art will readily understand. Such modifications and variations are considered to be within the purview and scope of the present invention as defined by the appended claims.

I claim:

1. A centrifugating device for biological liquids, comprising a fixed assembly for the inflow and outflow of the liquid to be centrifuged, a container rotatable about said fixed assembly coaxially with said fixed assembly, and an annular seal between said fixed assembly and container, said seal rotating with said container and having substantially line contact with said fixed assembly, said seal being at the top of the container and being easily insertable in and removable from said container, said seal being outside the path of the liquid to be centrifuged, the portions of said fixed assembly below said seal being of smaller diameter than the portions of said container that they pass upon assembly and disassembly of said fixed assembly and said container, whereby said assembly and disassembly are easily effected by the mere fricitional engagement and disengagement of the seal with and from the container.

2. A centrifugating device as claimed in claim 1, in which said fixed assembly comprises a head having a laterally extending outlet conduit for centrifuged liquid and a vertically extending axial inlet conduit for liquid to be centrifuged.

3. A centrifugating device as claimed in claim 2, and two horizontal spaced coaxial discs carried by said head within said container and between which said centrifuged liquid flows toward said outlet conduit.

4. A centrifugating device as claimed in claim 2, in which said container comprises a bottom plate secured to an internal member which is coaxial with said inlet conduit, there being passageways for liquid between said bottom plate and internal member, said bottom plate at its outer edges being secured to an external casing which is spaced radially outwardly from said internal member and which at its upper end carries said seal.

5. A centrifugating device as claimed in claim 1, said container having a radially inwardly extending shoulder adjacent its upper end against which said seal removably seats.

6. A centrifugating device as claimed in claim 1, in which said seal is made of an elastic deformable material.

7. A centrifugating device as claimed in claim 1, in which said container is made of an acrylic resin.

8. A centrifugating device as claimed in claim 1, in which said fixed assembly is at least principally made of acrylic resin.

9. A centrifugating device as claimed in claim 1, in which said fixed assembly comprises a short stainless steel sleeve that is disposed within and is in substantially line contact with said seal.

10. A centrifugating device as claimed in claim 9, the rest of said fixed assembly being of acrylic resin.

11. A centrifugating device as claimed in claim 9, the path of said liquid toward said outlet conduit being within said stainless steel sleeve.

12. A centrifugating device as claimed in claim 1, and a bracket for releasably supporting said fixed assembly, and means for selectively adjusting the position of said bracket in both horizontal directions.

13. A centrifugating device as claimed in claim 12, said bracket comprising an elongated member, means for releasably securing said elongated member to a fixed support, means for selectively adjustably rotating said elongated member about said fixed support, means for selectively adjusting the length of said elongated member, and means for releasably securing said fixed assembly to the outer end of said elongated member.

14. A centrifugating device as claimed in claim 13, said releasably securing means comprising a clamping plate, and means for releasably clamping a portion of said fixed assembly between said elongated member and said clamping plate.

15. A centrifugating device as claimed in claim 14, said fixed assembly having a non-circular flange thereon for engagement with said clamping means thereby to secure said fixed assembly to said bracket against rotation of said fixed assembly relative to said bracket.

* * * * *